United States Patent [19]

Apple

[11] Patent Number: 5,020,557

[45] Date of Patent: Jun. 4, 1991

[54] ROTATING CANOPY UMBRELLA

[75] Inventor: Phillip C. Apple, Mt. Pleasant Mills, Pa.

[73] Assignee: American Holtzkraft, Inc., Mt. Pleasant Mills, Pa.

[21] Appl. No.: 554,555

[22] Filed: Jul. 19, 1990

[51] Int. Cl.[5] ..... A45B 11/00

[52] U.S. Cl. ..... 135/15.1; 135/28

[58] Field of Search ..... 135/20 R, 39, 19.5, 135/20 M, 35 R, 35 S, 35 V, 28, 43, 38

[56] References Cited

U.S. PATENT DOCUMENTS

| | | | |
|---|---|---|---|
| 2,241,389 | 5/1941 | Berman | 135/19.5 |
| 2,465,140 | 3/1949 | Vila | 135/19.5 |
| 2,759,486 | 8/1956 | Pesaturo | 135/20 R |
| 3,177,883 | 4/1965 | Militano | 135/19.5 X |
| 3,784,250 | 1/1974 | Beeman | 297/184 |
| 4,312,371 | 1/1982 | Koon | 135/20 R X |
| 4,319,600 | 3/1982 | Roche | 135/20 M |
| 4,505,285 | 3/1985 | French | 135/35 V X |
| 4,567,907 | 2/1986 | Dubinsky | 135/20 M |
| 4,622,987 | 11/1986 | Redl et al. | 135/20 M |

*Primary Examiner*—David A. Scherbel
*Assistant Examiner*—Lan Mai

[57] ABSTRACT

A rotating canopy umbrella includes a canopy assembly that is free to rotate about the axis of a fixed center post. Also included in the design of the umbrella are disks of bearing material used to reduce surface friction during rotation.

3 Claims, 5 Drawing Sheets

20
22
34
36
18
12

ROTATING CANOPY UMBRELLA

FIELD OF THE INVENTION

This invention relates to heavier umbrellas suited for outdoor patio and recreational furniture use, particularly those units expected to withstand severe weather conditions.

BRIEF DESCRIPTION OF PRIOR ART

Outdoor umbrellas are most often constructed with a central post and rigidly attached canopy assembly that may be opened or closed as desired. The central post is either fixed to a supporting base or free to rotate within the constraints of a supporting base.

An umbrella exposed to severe winds in its open position results in large unstable forces applied to the canopy assembly. These forces are capable of producing unfavorable strains within both the canopy assembly and central post. An umbrella design incorporating a fixed central post and rigidly attached canopy assembly offers no relief from these internal strains. Allowing the central post and attached canopy assembly to rotate as one component converts this wind energy into rotational energy and reduces these internal strains while adversely forcing the entire weight of the umbrella to turn with the wind. Coupled with frictional effects at the base of umbrella post these opposing forces detract from the rotational benefits of the umbrella mechanism.

SUMMARY OF THE INVENTION

The primary objective of the present invention is to reduce the strain on the umbrella components by designing a canopy assembly that rotates freely about the axis of a centrally fixed hollow wooden post. The hollow post is re-enforced with a galvanized steel tubing that runs along its inside diameter. The canopy assembly consists of a plurality of ribs and struts surrounding the post and a fabric canopy attached to the ribs. The ribs are pivotally connected to a rotating hub at their inner ends and supported by a plurality of struts near their midpoints. The struts are pivotally connected at their inner ends to a second rotating hub that is located below the first hub and free to slide along the length of the post. Sliding this bottom hub up along the length of the post opens the umbrella. A rigidly fixed end cap and stop restrain the top hub from sliding along the post while permitting the hub to rotate freely about its axis. A movable stop is used to secure the bottom rotating hub from sliding and may be pinned to the post at a variety of locations. Thin disks of bearing material are attached to the rotating hubs, stops, and end cap to ensure low-friction contact surfaces on which both hubs are free to rotate.

Since the hubs are free to rotate about the axis of the fixed post and because the bearing disks provide a low-friction contact surface, the canopy, ribs, struts, and hubs are free to rotate in the wind. The rotation of only the canopy assembly will minimize the stresses within the canopy assembly and central post during severe winds.

Other objects and features of the present invention will become apparent as the description proceeds. A more detailed explanation of the invention is provided in the following embodiment and accompanying drawings.

DESCRIPTION OF THE PREFERRED EMBODIMENT

Figure 1:
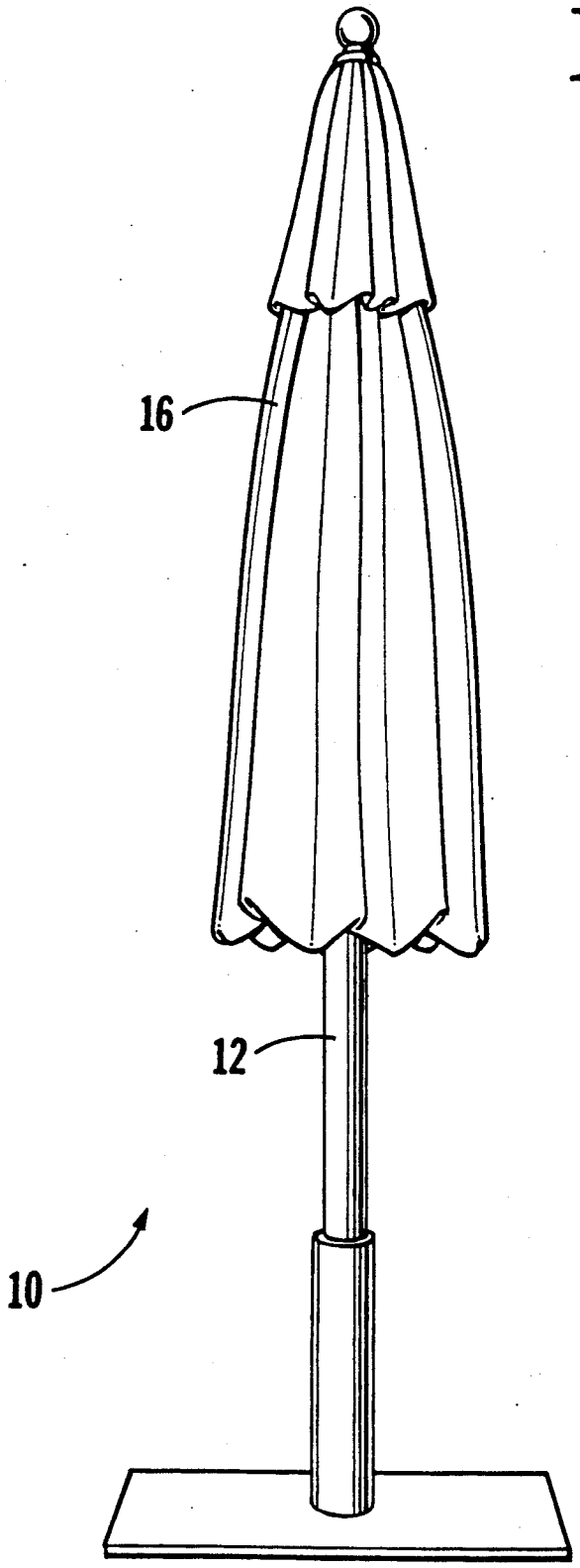
FIG. 1 is a perspective view of the umbrella in its closed position.
Figure 2:
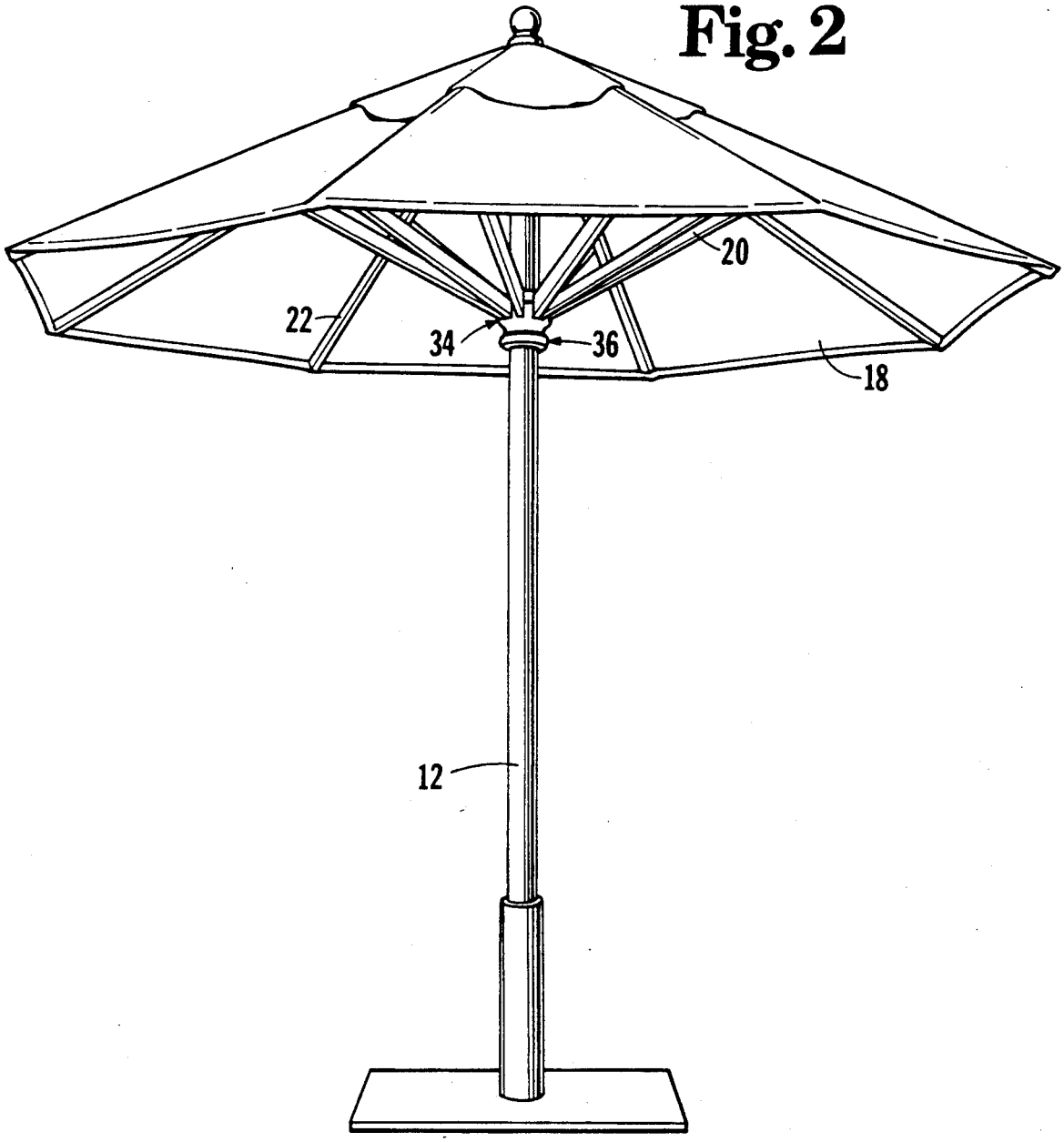
FIG. 2 is a perspective view of the umbrella in its open position.
Figure 3:
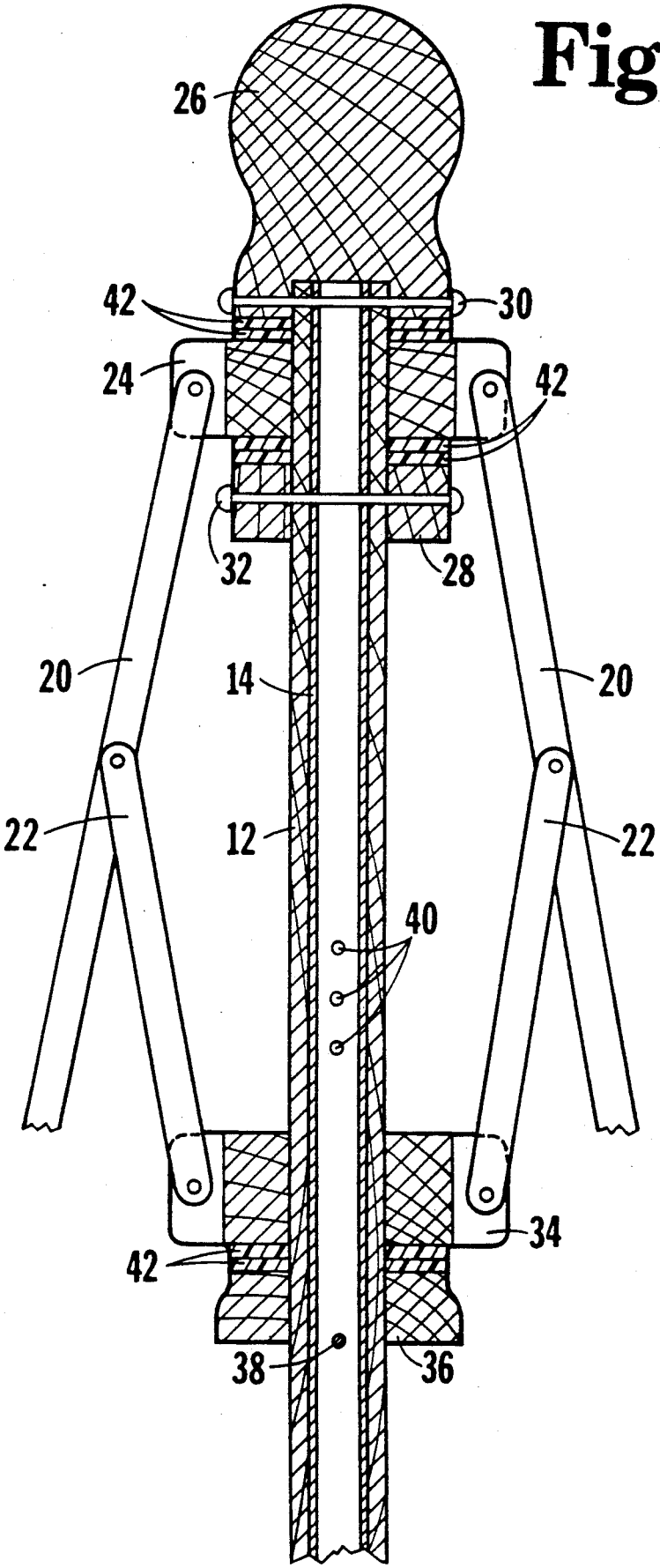
FIG. 3 is a detailed sectional view taken longitudinally through the central post, showing the canopy assembly in the umbrella's closed position.
Figure 4:
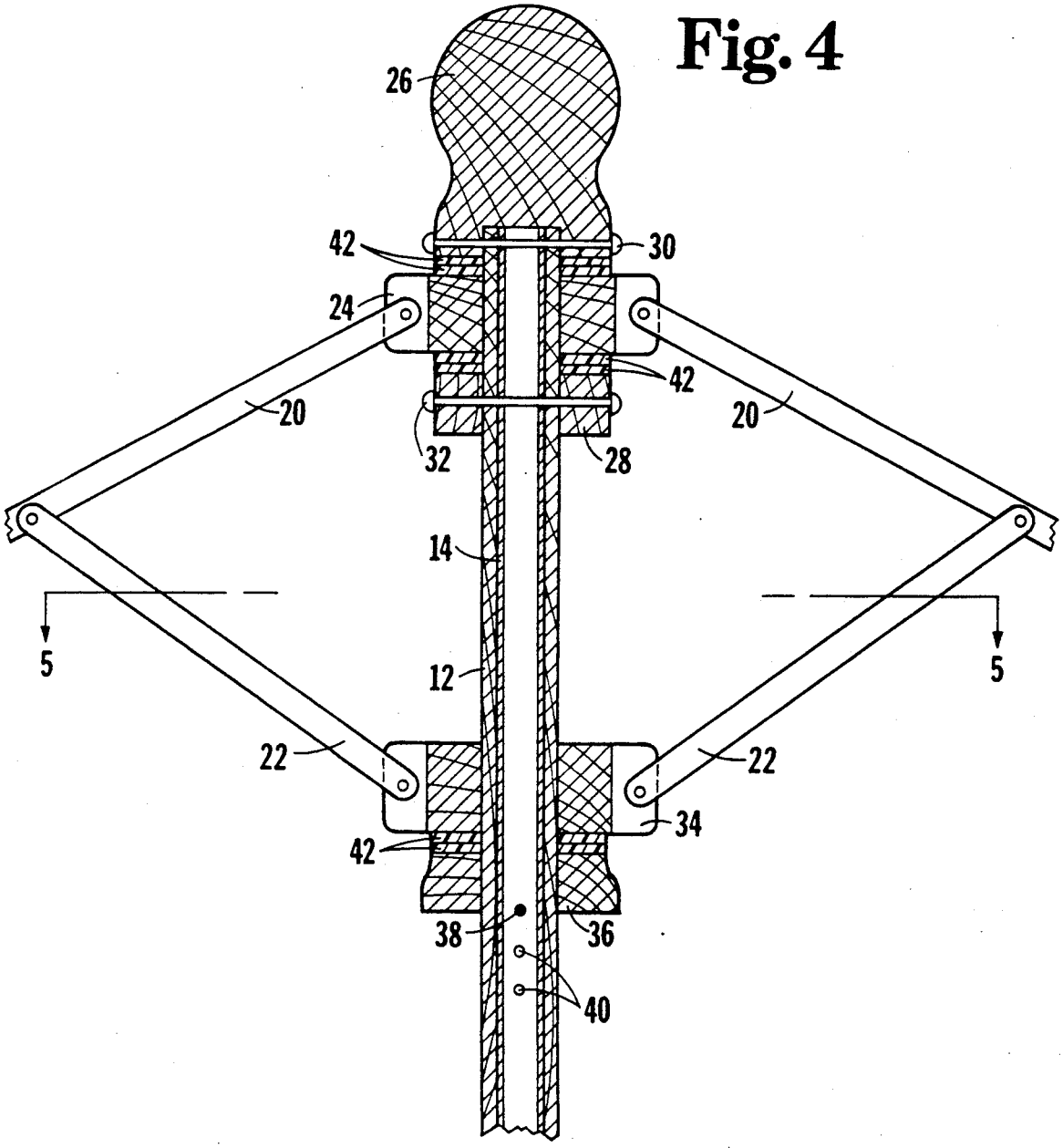
FIG. 4 is a detailed sectional view taken longitudinally through the central post, as in FIG. 3, showing the canopy assembly in the umbrella's open position.
Figure 5:
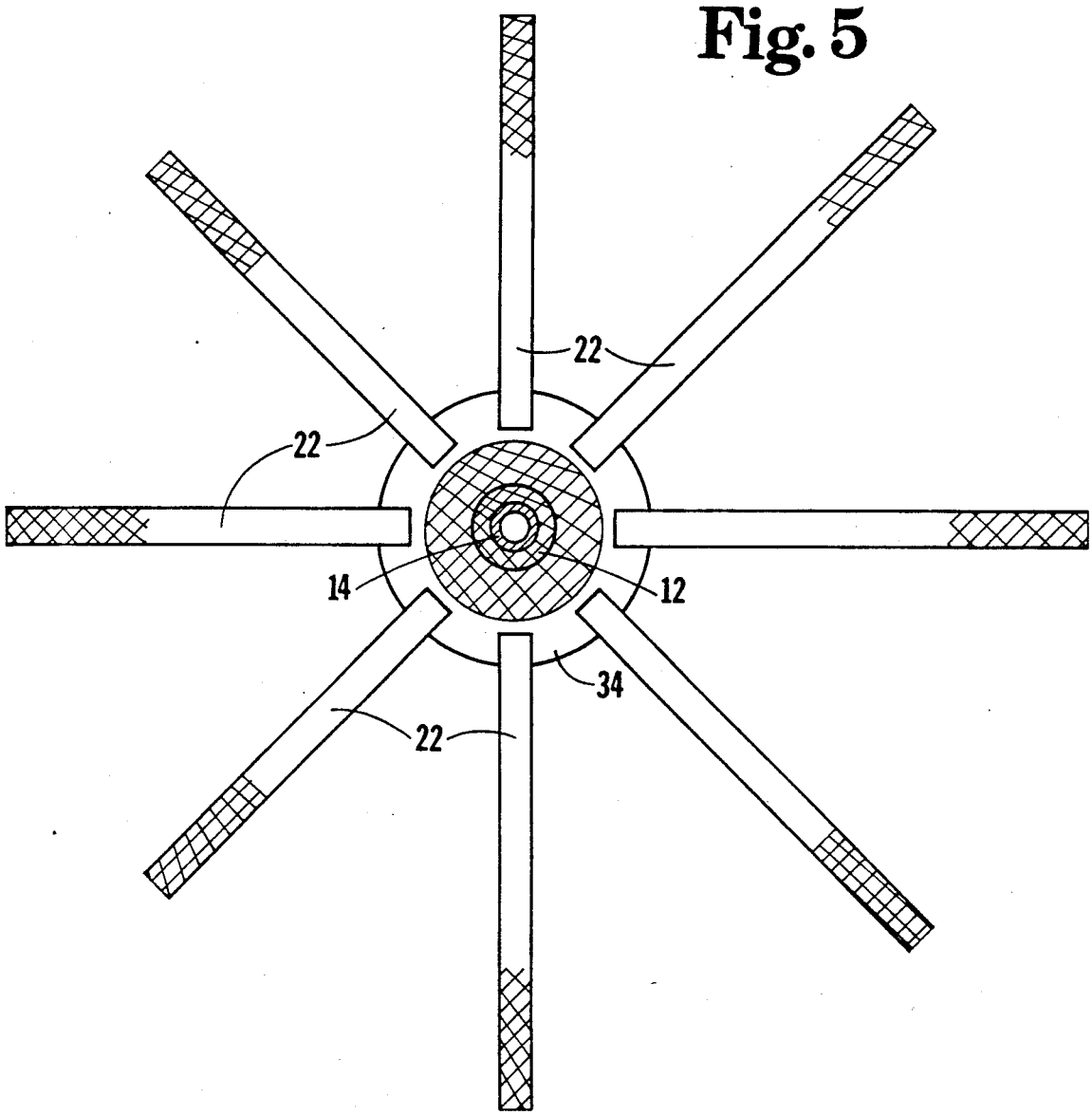
FIG. 5 is a sectional view taken along line 5—5 of FIG. 4.

Umbrella 10 includes a hollow wooden post 12 filled with a galvanized steel tubing 14, and a canopy assembly 16 mounted on the post. The assembly includes a fabric canopy 18 and a rigid framework of ribs and struts. The canopy fabric is attached to the ribs to provide shade and protection when opened. The inner ends of the ribs 20 are pivotally connected to a wooden rotating hub 24 surrounding the post near its top and the midpoints of the ribs are suported by the struts 22. The rotating hub 24 is held in place by an end cap 26 and a wooden stop 28 both of which are rigidly attached to wooden post 12 with fasteners 30 and 32. The inner ends of the struts 22 are pivotally connected to a second rotating hub 34 which surrounds post 12 and freely slides along its length. Rotating hub 34 is movable on the post between a lower, retracted position shown in FIG. 3 where the ribs are drawn together nearly parallel to the post to collapse the umbrella canopy, and an extended position shown in FIG. 4 where the hub is raised higher along the post and the ribs are opened to spread the canopy. A second, movable stop 36 slides up under the lower rotating hub 34 to hold it in place and is secured to post 12 with a removable pin 38. Located along the length of the post are several stop pin holes 40 in which pin 38 may be inserted to allow the user to choose the extent to which the umbrella is opened.

Bearing disk 42 is attached to the bottom of end cap 26 and slidable hub 34, the top and bottom of rotating hub 24, and the top of stops 28 and 36. These disks provide for a reduced-friction surface on which both hubs rotate.

While I have illustrated and described a preferred embodiment of my invention, it is understood that this is capable of modification, and I therefore do not wish to be limited to the precise details set forth, but desire to avail myself of such changes and alterations as fall within the purview of the following claims.

What I claim as my invention is:

1. An umbrella incorporating a canopy assembly that is free to rotate about its axis including a central post, a plurality of ribs surrounding the post and pivotally connected to a rotating hub surrounding the post near the post's upper end, an end cap and stop located on either side of the foregoing rotating hub and rigidly attached to the post confining the hub to a location near the upper end of the post, a second rotating hub surrounding the post and free to slide between the upper and lower ends of the post, a plurality of struts surrounding the post and having post ends pivotally connected to the sliding hub and rib ends pivotally connected to the ribs so that moving the sliding hub upwardly along the post opens the ribs, a canopy attached to the ribs, a movable stop limiting the movement of the sliding hub down the length of the post, an umbrella having a collapsed position where the canopy, ribs and struts are adjacent the post and the sliding hub is located in a lowered position on the post, and an open position where the canopy, ribs, and struts are opened away from the post and the sliding hub is located in an elevated position.

2. An umbrella as in claim 1 wherein attached to the bottom of said end cap and sliding hub, the top of both said stops, and the top and bottom of said upper rotating hub are disks of bearing material.

3. An umbrella as in claim 1 wherein said post is wooden, hollow, and filled with a galvanized steel tubing.

* * * * *